US009803435B2

(12) United States Patent
Louviere et al.

(10) Patent No.: US 9,803,435 B2
(45) Date of Patent: Oct. 31, 2017

(54) METHOD AND APPARATUS FOR MULTI-SLIP GRIPPING OF PIPE AND TUBULAR GOODS

(71) Applicant: OFFSHORE ENERGY SERVICES, INC., Lafayette, LA (US)

(72) Inventors: Jeremy Louviere, Broussard, LA (US); Jamie Meaux, Broussard, LA (US)

( * ) Notice: Subject to any disclaimer, the term of this patent is extended or adjusted under 35 U.S.C. 154(b) by 209 days.

(21) Appl. No.: 14/208,051

(22) Filed: Mar. 13, 2014

(65) Prior Publication Data

US 2014/0262538 A1 Sep. 18, 2014

Related U.S. Application Data

(60) Provisional application No. 61/792,038, filed on Mar. 15, 2013.

(51) Int. Cl.
*E21B 19/07* (2006.01)
*E21B 19/10* (2006.01)

(52) U.S. Cl.
CPC ..... *E21B 19/10* (2013.01)

(58) Field of Classification Search
CPC ..... E21B 19/07; E21B 19/10; E21B 33/0422
See application file for complete search history.

(56) References Cited

U.S. PATENT DOCUMENTS 1,234,041 A 7/1917 Knapp
2,589,159 A 3/1952 Stone
4,269,277 A 5/1981 Baugh
6,089,338 A * 7/2000 Bouligny, Jr. ..... E21B 19/10 166/75.14

OTHER PUBLICATIONS

PCT International Search Report and Written Opinion, dated Aug. 11, 2014.

* cited by examiner

*Primary Examiner* — Catherine Loikith
(74) *Attorney, Agent, or Firm* — Ted M. Anthony

(57) ABSTRACT

A slip assembly for gripping against the external surface of a section of pipe or other tubular goods and supporting axial loading has multiple sets of cooperating wedge-like slip members movably mounted within a slip bowl. A first set of slip members having a smaller taper angle (that is, having a greater vertical component) exerts a predetermined and limited radial gripping force on the pipe or other tubular good. Thereafter, a second set of slip members having a larger taper angle (that is, having a lesser vertical component) takes over and exerts additional radial gripping force on the pipe or other tubular good.

9 Claims, 5 Drawing Sheets

METHOD AND APPARATUS FOR MULTI-SLIP GRIPPING OF PIPE AND TUBULAR GOODS

CROSS REFERENCES RELATED TO APPLICATION

Priority of U.S. provisional patent application Ser. No. 61/792,098, filed Mar. 15, 2013, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a slip assembly for gripping pipe and other tubular goods. More particularly, the present invention pertains to a slip assembly for gripping heavy weight pipe and other tubular goods, while reducing or eliminating damage to exterior surfaces of such pipe and/or tubular goods.

2. Brief Description of the Prior Art

Conventional drilling rigs typically comprise a supportive rig floor, a substantially vertical derrick extending above said rig floor, and a traveling block or other hoisting mechanism which can be raised and lowered within said derrick. In addition to other tasks, such equipment can be used to insert and remove pipe and other tubular goods from a wellbore situated below said rig floor and derrick.

During pipe installation operations, pipe is typically inserted into a well in a number of different sections of roughly equal length. These sections, often called "joints," are typically screwed together or otherwise joined end-to-end at a drilling rig in order to form a roughly continuous "string" of pipe that extends into said wellbore. As the bottom end of the pipe string penetrates deeper into a wellbore, additional joints of pipe are added to the ever lengthening pipe string at the drilling rig. Conversely, when a pipe string is being removed from a wellbore, the upper portion of said pipe string is pulled from the well and one or more joints are unscrewed in the rig derrick until a desired length of pipe has been retrieved from said well.

The process of inserting a string of pipe in a well is typically commenced by lowering a first section of pipe into a wellbore at the rig floor, and suspending said section of pipe in place using a set of "lower slips." When set, such lower slips—also sometimes referred to as "spider slips"—generally surround an opening in the rig floor (which is aligned with the upper opening of said well) through which the upper end of said first section of pipe protrudes. The lower slips grip against the external surface of said pipe section and hold such pipe in place.

Thereafter, a second section of pipe is lifted within the drilling rig derrick and suspended in said derrick from the rig's traveling block, top drive unit or other hoisting mechanism. Said second section of pipe is then positioned in axial alignment above the first section of pipe which was previously run into the well and suspended from the lower slips. The lower end of said second pipe section is then connected to the upper end of said first pipe section.

Once said pipe sections are joined, the pipe string can be suspended from the rig's traveling block (or top drive unit or other hoisting mechanism), allowing the total weight of said pipe string to be suspended within the derrick. In the position, the lower slips can be disengaged from gripping the pipe. The joined sections of pipe can then be lowered further into the wellbore using the rig's traveling block, top drive unit or other hoisting mechanism. After the pipe string has been lowered a desired length within the wellbore, said lower slips can again be engaged to grip the pipe string and hang it in place within said wellbore. Thereafter, the process can be repeated until a desired length of pipe has been inserted into the well.

Conventional slip assemblies (including, without limitation, lower or "spider" slip assemblies) typically utilize a plurality of wedge-shaped slip members, movably disposed within a bowl-like structure, in order to selectively grip against the outer surface of pipe and/or other tubular members. Each such slip member typically has a substantially vertical surface and a tapered back side. Although the angle of such taper can vary, conventional slip members typically have a taper angle of 9.46 degrees. The substantially vertical surface has gripping teeth or "dies" and is oriented inwardly toward the pipe or other tubular member, while the tapered back side is oriented facing away from such pipe or other tubular member and is slidably mounted in said slip bowl. The inwardly facing gripping surface can also have an arcuate shape that conforms to the outer surface of a section of pipe or other tubular to be gripped.

When pipe is gripped by a slip assembly, the tapered outer surfaces of the slip members, in cooperation with the corresponding tapered inner surface of a slip bowl in which such slip members are received, force said slip members radially inward around the outer surface of the pipe. Such slip members essentially wedge between the slip bowl and the pipe, thereby causing said slip members to grip against the outer surface of the pipe. As a result, the greater the axial load acting on said slip members, the greater the radial gripping force that said slip members impart on said pipe.

Designing of slip assemblies in general, and slip members in particular, can be very challenging. Generally, the greater the taper angle of such slip members, the lower the radial force that said slip members impart on pipe. Conversely, the lower the taper angle of such slip members, the greater the radial force that said slip members generally impart on pipe. Thus, if a slip taper angle is too large, the slip members will not create enough radial force to grip against the outer surface of the pipe. However, if a slip taper angle is too small, such slip members may impart too much radial force on pipe, thereby damaging the outer surface of such pipe and, in extreme cases, causing such pipe to collapse or crush.

Slip assembly design is further complicated by changes in pipe and other tubular goods used in modern wells. As wells are being drilled to deeper depths and/or in more challenging environments, pipe and other tubular goods used to service and equip such wells is evolving. For example, casing used in such wells is often larger and/or heavier than casing used in other wells. Further, casing, production tubing and/or other tubular goods are often constructed of and/or coated with premium materials that are less rugged and more easily damaged than conventional tubular materials. Care must be taken that slip members do not damage such pipe and/or other tubular goods including, without limitation, as a result of excessive radial gripping forces.

Conventional slip assemblies have proven to suffer from some significant limitations. Under extreme loading conditions, conventional slip assemblies can cause a crushing effect that can damage pipe and other tubular goods gripped by such slip assemblies. This crushing effect can be lessened by increasing the taper angle of slip members and a cooperating slip bowl. However, when this angle is increased, the slip members may have difficulty engaging against and gripping a section of pipe, especially when such slip members must engage against a relatively light load (such as, for example, when relatively few pipe sections are joined to a pipe string).

Thus, there is a need for a slip assembly that can be used to grip and convey heavy weight pipe and/or other tubular goods, such as casing, during installation and retrieval operations. Such slip assembly should be capable of generating sufficient radial force to securely grip heavy weight pipe and other tubular goods, while preventing crushing and/or damage to the external surfaces of such pipe and tubular goods.

SUMMARY OF THE INVENTION

The slip assembly of the present invention comprises a plurality of slip members that cooperate to grip against the outer surface of a section of pipe. Although multiple different applications can be envisioned without departing from or limiting the scope of the present invention, said slip assembly is described herein primarily in connection with a set of lower "spider" slips. Notwithstanding the foregoing, it is to be observed that the slip assembly of the present invention can be beneficially used in connection with many different uses and/or applications.

The slip assembly of the present invention comprises a slip bowl member having a central bore for receiving a section of pipe or other tubular, and defining a generally arcuate inner surface substantially surrounding said bore. Said inner surface is generally disposed at an acute angle relative to the central longitudinal axis of said bore, wherein the diameter of said bore is greater at the top of said bore than at the base of said bore. A plurality of central slip members is movably disposed within said bore of said bowl member.

Said central slip members have a substantially wedge-shaped or tapered contour profile; each of said central slip members is wider at its top than at its bottom. Each of said central slip members further defines an inwardly-facing and generally arcuate inner surface and an outwardly-facing and generally arcuate outer surface. The outer surface of each central slip member is slidably disposed on the cooperating inner surface of said slip bowl bore, while the inner surface of each central slip member defines an angled surface having at least one upwardly facing shoulder member.

The inner and outer surfaces of said central slip members are each disposed at acute angles relative to the central longitudinal axis of said slip bowl bore. In a preferred embodiment, the angle of said inner surface (relative to the central longitudinal axis of said slip bowl bore) is less than the angle of said outer surface (relative to the central longitudinal axis of said slip bowl bore).

A supplementary slip member is moveably disposed on the inner surface of each central slip member. Said supplementary slip members each have a substantially wedge-shaped or tapered contour profile; each of said supplementary slip members is wider at its top than at its bottom. Said supplementary slip members each define a generally arcuate inwardly-facing inner surface, as well as a generally arcuate outwardly-facing outer surface having at least one downwardly facing shoulder member. Said inner surfaces of said supplemental slip members are each oriented substantially parallel to the central longitudinal axis of said slip bowl bore, while said outer surfaces are each oriented at an acute angle relative to said axis. The outer surface of each supplementary slip member is slidably disposed on a cooperating inner surface of a corresponding central slip member.

Insert dies having a plurality of teeth-like projections are disposed along the inner surfaces of said supplemental slip members. Said insert dies have generally arcuate faces which beneficially have similar curvature to the outer surface of pipe or tubular goods to be gripped by said insert dies. Alternatively, said insert dies can optionally have substantially flat faces with little or no arcuate curvature, which may be more effective when used with certain types or sizes of pipe.

When the slip assembly of the present invention is used to grip against the external surface of a pipe section or other tubular, said supplemental slip members will first engage against said pipe or tubular. Said supplemental slip members are oriented at a smaller (that is, more vertical) slip angle than said central slip members. As a result, said supplemental slip members will exert sufficient radial force on said pipe so that said pipe will not slip, even at lower string weights.

Although the more aggressive vertical slip angle of said supplemental slip members could ordinarily cause pipe crushing or other damage, said supplemental slip members have a limited (but adjustable) axial travel distance. As a result, the teeth-like projections of said insert dies are permitted to penetrate the outer surface of a pipe section only a predetermined amount. In a preferred embodiment, said teeth-like projections generate a sufficient friction factor (typically over 1), even when debris or foreign material (for example, mill scale, pipe dope or drilling mud) is on the outer surface of such pipe, to securely grip said pipe. At this point, a less aggressive (that is, more horizontal) slip angle of said central slip members takes over, ensuring that radial loads will not increase as fast as pipe weight increases and minimizing the crushing effect of such slip members. Slip angles of 15 degrees or more, and the benefits associated with such higher slip angles, are possible as a result of the present invention.

The slip assembly of the present invention automatically transfers from the more aggressive slip angle of the supplemental slip members to the less aggressive slip angle of the central slip members. Thus, no interaction from an operator is required, thereby reducing the risk associated with human error. A bias spring can be used to reset the slip members after pipe is released, thereby readying said slip members for a subsequent section of pipe.

A slip set indication assembly can provide a signal that the slip members of the present invention have reached a fully engaged position. Such signal allows confirmation that said slip members have fully engaged against pipe, and are not partially engaged (for example, due to debris inadvertently wedging around said pipe and/or between said slip members). The present invention has a large gripping range so multiple pipe diameters can be accommodated without significant changing of parts or other equipment in the field.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
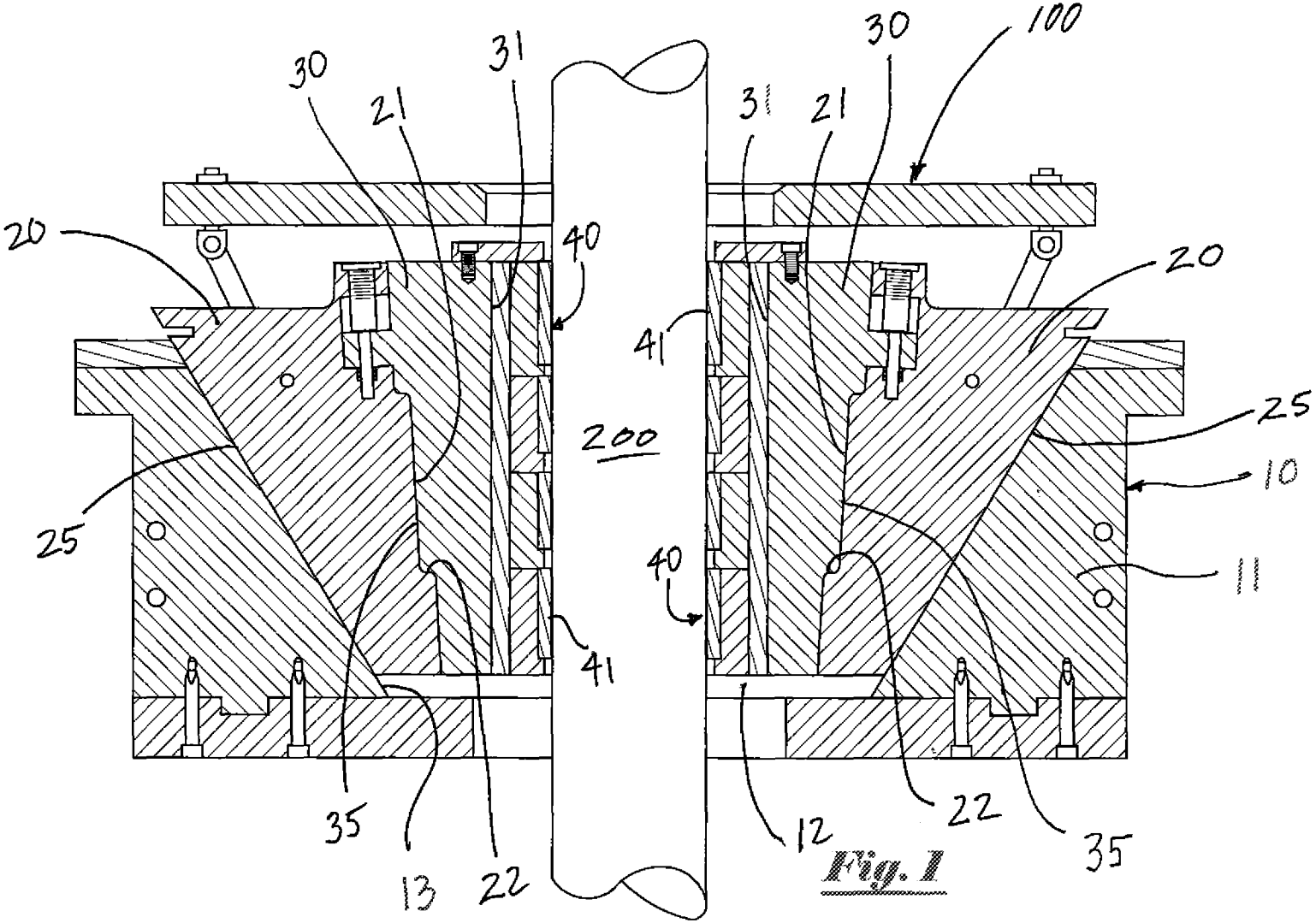
FIG. 1 depicts a side sectional view of a section of pipe being gripped by the slip assembly of the present invention.

FIG. 1 depicts a side sectional view of a pipe section 200 being gripped by slip assembly 100 of the present invention. As depicted in FIG. 1 and as described herein, slip assembly 100 comprises a set of "lower slips" or "spider slips" that are generally disposed surrounding an opening in a rig floor that is substantially aligned with the upper opening of a well. Notwithstanding the foregoing, it is to be observed that the slip assembly of the present invention can be utilized in connection with other pipe gripping uses or applications (other than lower spider slips) without departing from the scope of the present invention. Generally, slip assembly 100 of the present invention comprises a plurality of slip members, as more fully described herein, that cooperate to selectively grip against the outer surface of pipe section 200.

Slip assembly 100 of the present invention comprises a slip bowl member 10 having a body member 11 with a central bore 12 extending therethrough for receiving a section of pipe or other tubular (such as pipe section 200), and defining a generally arcuate inner surface 13. Said inner surface 13 is generally disposed at an acute angle relative to the central longitudinal axis of bore 12 (and pipe section 200). Accordingly, the diameter of bore 12 is greater at its upper end than at its lower end. Although not depicted in FIG. 1, a plurality of elongate keyway slots extend along at least a portion of said bore 12.

Still referring to FIG. 1, a plurality of central slip members 20 are slidably disposed within bore 12 of slip bowl assembly 10. Said central slip members 20 have a substantially tapered contour profile, wherein each of said central slip members 20 is wider at its top 27 than at its bottom 28. Each of said central slip members 20 further defines an inwardly-facing inner surface 21 and an outwardly-facing outer surface 25 that is generally shaped to conform to inner surface 13 of bore 12 of slip bowl member 10. Outer surface 25 of each central slip member 20 is slidably disposed on cooperating inner surface 13 of slip bowl 10. Said inner surface 21 of each central slip member 20 defines an angled surface having at least one upwardly facing shoulder member 22.

A supplementary slip member 30 is moveably disposed on inner surface 21 of each central slip member 20. Said supplementary slip members 30 each have a substantially wedge-shaped or tapered contour profile; each of said supplementary slip members is wider at its top 37 than at its bottom 38. Said supplementary slip members each define an inwardly-facing inner surface 31, as well as outwardly-facing outer surface 35 having at least one downwardly facing shoulder member 36. Insert die assemblies 40 having a plurality of teeth-like projections are disposed along the inner surfaces 31 of said supplemental slip members 30. Said insert die assemblies 40 have generally arcuate inner surfaces which beneficially have similar curvature to the outer surface of pipe section 200. Alternatively, said insert die assemblies 40 can optionally have substantially flat faces with little or no arcuate curvature, which may be more effective when used with certain types or sizes of pipe.

Figure 2:
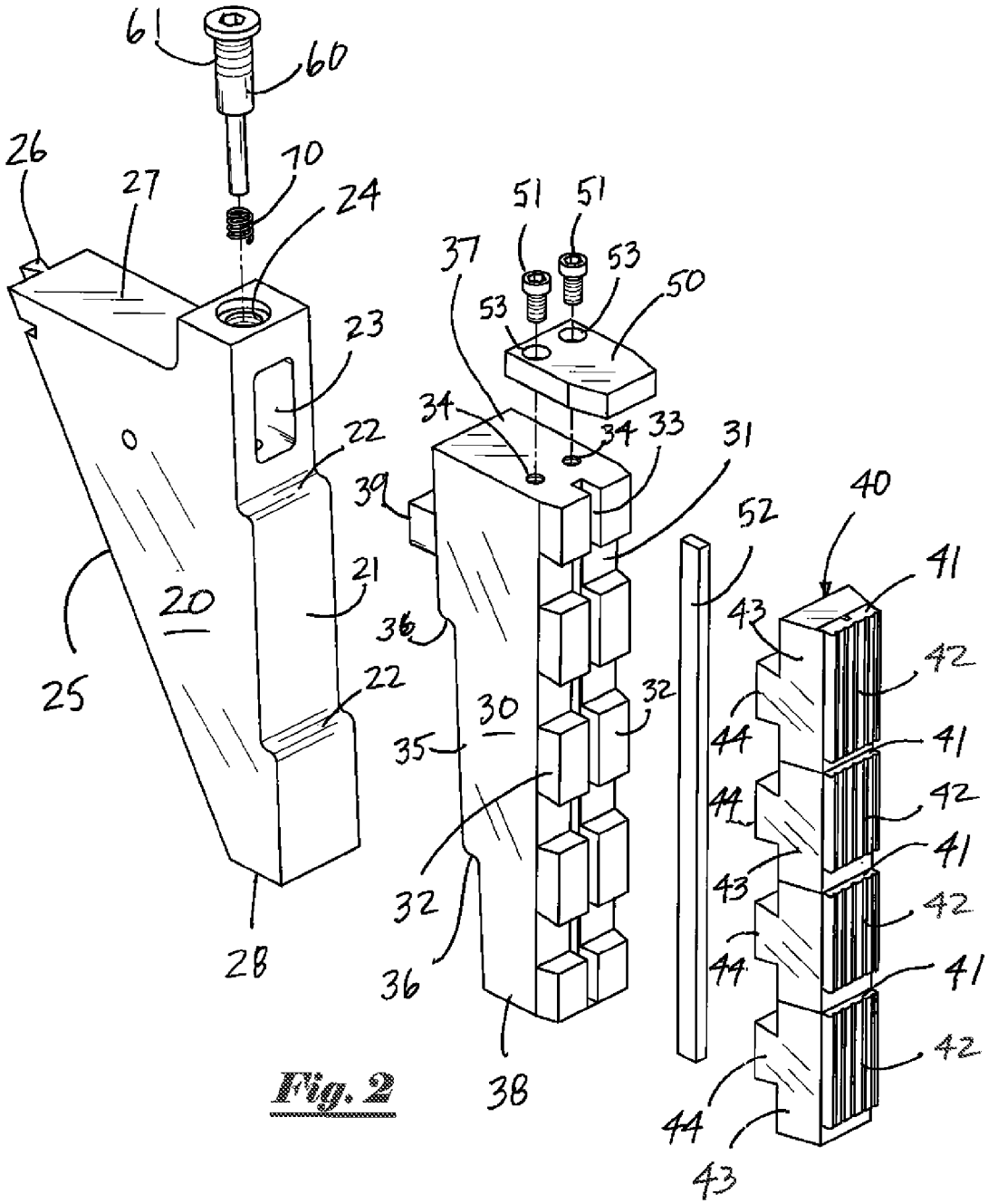
FIG. 2 depicts an exploded perspective view of slip members and insert dies of the present invention.

FIG. 2 depicts an exploded perspective view of a central slip member 20, supplemental slip member 30 and an insert die assembly 40 of the present invention. Said central slip member 20 has a substantially tapered contour profile defining an inwardly-facing inner surface 21 and an outwardly-facing outer surface 25. At least one alignment key member 26 extends from said outer surface 25. As depicted in FIG. 1, outer surface 25 of each central slip member 20 is slidably disposed on cooperating inner surface 13 of slip bowl 10; although not shown in FIG. 1, said alignment key 26 can be slidably received within a keyway slot extending along said inner surface 13 of bore 12 of slip bowl 10 to secure said central slip members 25 against lateral movement within said bore 12.

Inner surface 21 of central slip member 20 defines an angled surface having upwardly facing shoulder members 22, as well as a recess or void 23 extending into the body of said central slip member 20. Threaded bore 24 extends from the upper surface of said central slip member 20 into recess 23. Adjustment bolt 60 and bias spring 70 are received within said threaded bore 24 as described in more detail below.

As noted above, supplementary slip member 30 is moveably disposed on inner surface 21 of central slip member 20. Supplementary slip member 30 has a substantially wedge-shaped or tapered contour profile defining inner surface 31 and outer surface 35 having downwardly facing shoulder members 36. Biasing member 39 extends from said outer surface 35 of supplementary slip member 30 and is generally aligned with recess 23 in inner surface 21 of central slip member 20. Although not visible in FIG. 2, said biasing member 29 has a bore extending through said biasing member.

In a preferred embodiment, inner surface 31 has a plurality of beneficially arranged die carrier projections 32 and a central elongate slot 33 for mounting insert die assemblies 40. Insert die assemblies 40 comprise die carriers 43 having rear wedge projections 44. Said rear wedge projections 44 are beneficially arranged to engage in mating relationship between die carrier projections 32 of supplemental slip member 30. Locking rod 52 can be received within central elongate slot 33 and secured in place to prevent lateral movement of said die carriers 43 relative to supplemental slip member 30. In a preferred embodiment, said locking rod 52 can be secured in place using locking plate 50 having bores 53 extending there through; locking plate 50 is removably anchored to supplemental slip member 30 using locking bolts 51 that extend through bores 53 and are secured in threaded bores 34.

Insert die assemblies 40 each further comprise die members 41 having a plurality of inwardly facing teeth-like projections 42. Said insert die members 41 are disposed along the inner surfaces of said die carriers 43 and can have generally arcuate inner surfaces which beneficially have similar curvature to the outer surface of a pipe or tubular to be gripped by slip assembly 100 of the present invention (such as, for example, pipe section 200 depicted in FIG. 1). Alternatively, said insert dies can optionally have substantially flat faces with little or no arcuate curvature, which may be more effective when used with certain types or sizes of pipe.

Referring to FIG. 1, inner surface 21 and outer surface 25 of each central slip member 20 are disposed at acute angles relative to the central longitudinal axis of slip bowl bore 12 and pipe section 200; in most operational installations, including the configuration of slip assembly 100 depicted in FIG. 1, the central longitudinal axis of slip bowl bore 12 and pipe section 200 are both oriented in a substantially vertical direction. In a preferred embodiment, the angle formed by said inner surface 21 and said vertical axis is less than the angle formed by outer surface 25 and said vertical axis.

Similarly, outer surface 35 of each supplemental slip member 30 is also disposed at an acute angle relative to the central longitudinal axis of slip bowl bore 12 and pipe section 200 (vertical axis depicted in FIG. 1); such acute angle is substantially the same as the acute angle formed by said vertical axis and inner surface 21 of central slip member 20. By contrast, surface 31 of each supplemental slip member 30 is oriented substantially parallel to the central longitudinal axis of slip bowl bore 12 and pipe section 200 (vertical axis depicted in FIG. 1).

Figure 3:
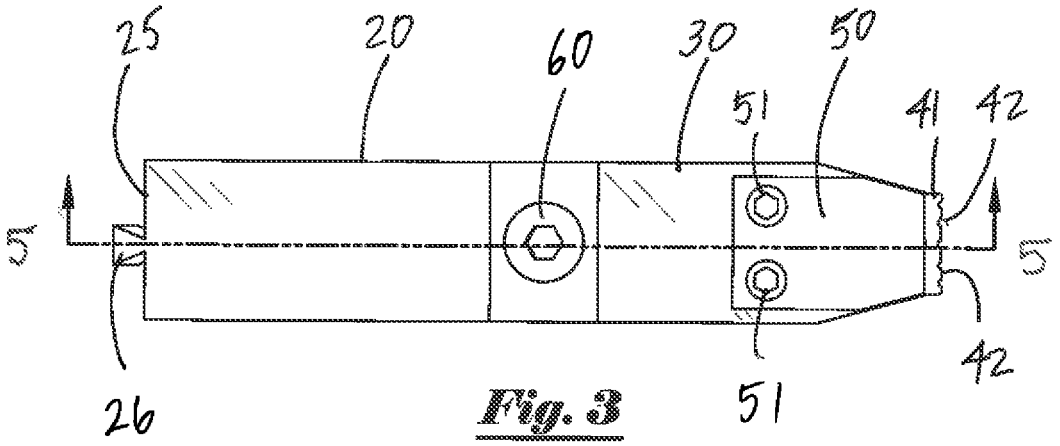
FIG. 3 depicts a top view of assembled slip members and insert dies of the present invention.

FIG. 3 depicts a top view of an assembled central slip member 20, supplemental slip member 30 and insert die assembly 40 of the present invention. As discussed above, said central slip member 20 has a substantially tapered contour profile defining outwardly-facing outer surface 25 having at least one alignment key member 26 extending from said outer surface 25. Outer surface 35 of supplementary slip member 30 is moveably mounted against inner surface 21 of central slip member 20. Insert die assembly 40, comprising die member 41 having a plurality of inwardly facing teeth-like projections 42, is attached to supplemental slip member 30 and secured in place using locking plate 50 and locking bolts 51.

Figure 4:
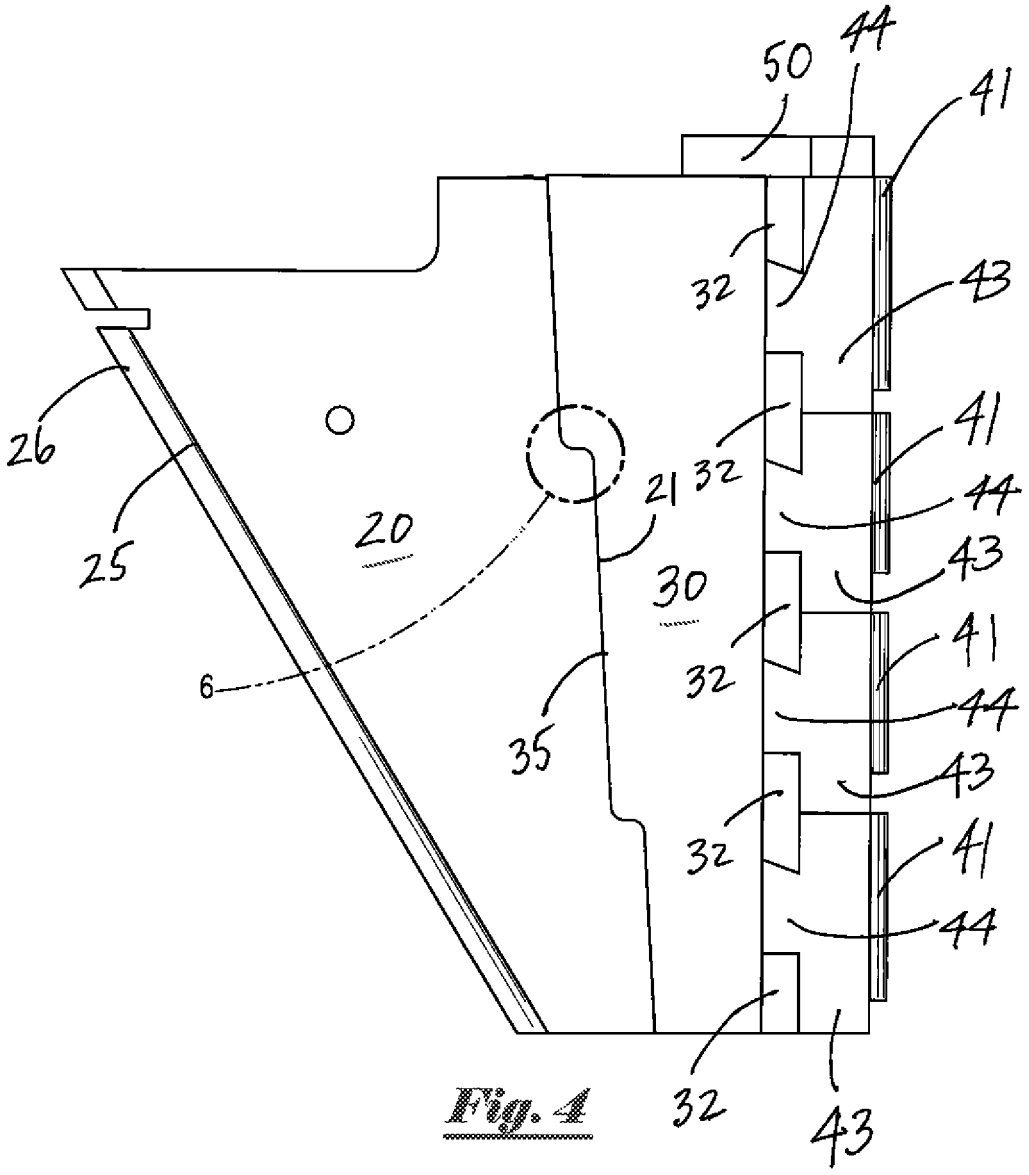
FIG. 4 depicts a side view of assembled slip members and insert dies of the present invention.

FIG. 4 depicts a side view of an assembled central slip member 20, supplemental slip member 30 and insert die assemblies 40 of the present invention. Central slip member 20 has a substantially tapered contour profile defining outwardly-facing outer surface 25 and inner surface 21, as well as protruding alignment key member 26 extending from said outer surface 25. Outer surface 35 of supplementary slip member 30 is moveably mounted on inner surface 21 of central slip member 20.

Inner surface 31 of supplemental slip member 30 has a plurality of beneficially arranged die carrier projections 32. Rear wedge projections 44 of die carriers 43 are beneficially arranged to engage in mating relationship between said die carrier projections 32 of supplemental slip member 30. Locking plate 50 is anchored to supplemental slip member 30 (using locking bolts 51 not visible in FIG. 4). Insert die members 41, each having a plurality of inwardly facing teeth-like projections 42, are disposed along the inner surfaces of die carriers 43.

Figure 5:
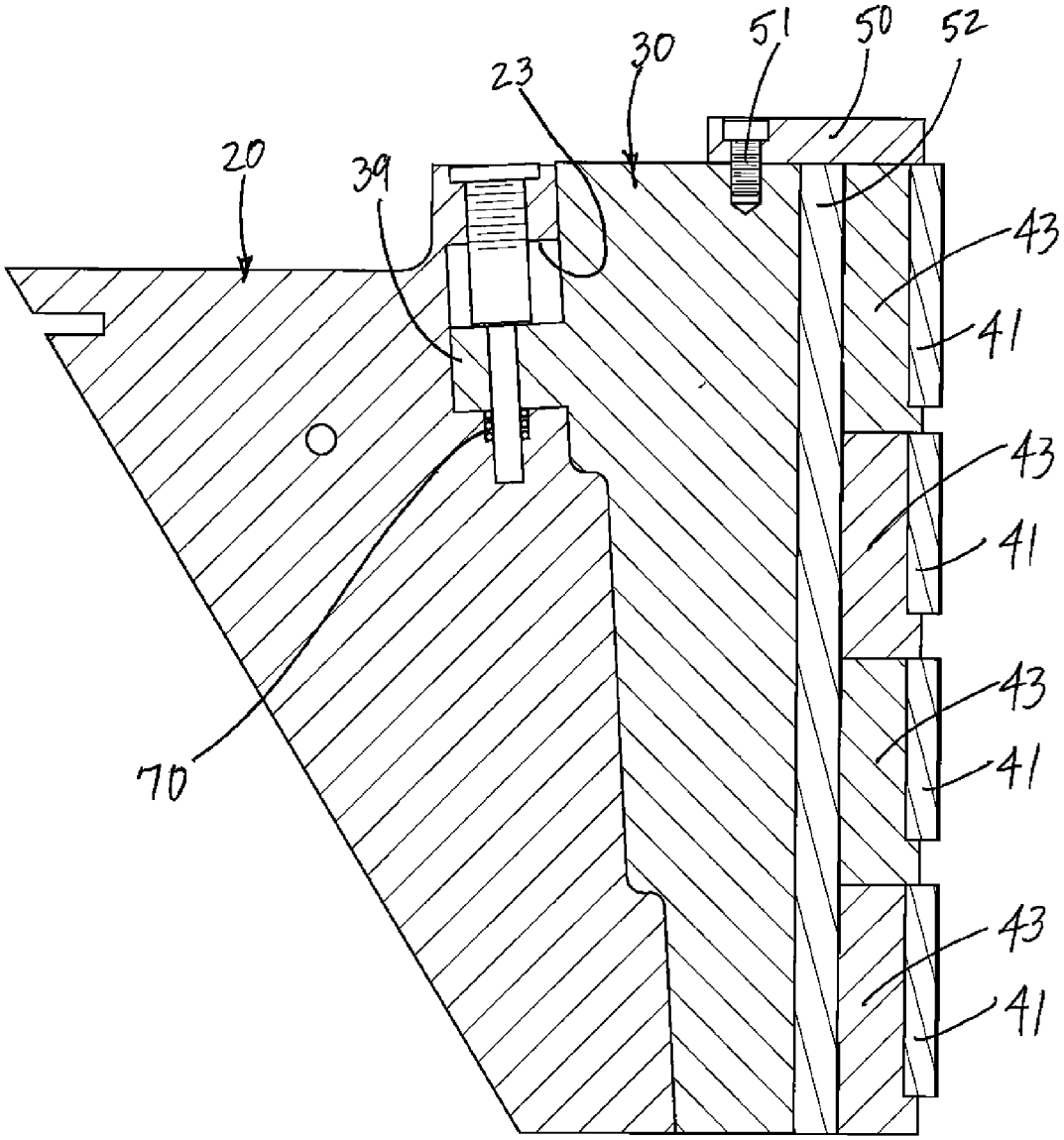
FIG. 5 depicts a side sectional view of assembled slip members and insert dies of the present invention along line 5-5 in FIG. 3.

FIG. 5 depicts a side sectional view of assembled slip members and insert die assemblies of the present invention along line 5-5 in FIG. 3. Central slip member 20 has a substantially tapered contour profile defining outwardly-facing outer surface 25 having protruding alignment key member 26 extending from said outer surface 25. Outer surface 35 of supplementary slip member 30 is moveably mounted against inner surface 21 of central slip member 20.

Biasing member 39 extends from said outer surface 35 of supplementary slip member 30 and is received within recess 23 in inner surface 21 of central slip member 20. Bias spring 70 is disposed below said biasing member 39 within said threaded bore 24, while bolt 60 having external threads 61 is received within said threaded bore 24 and extends through bore **39*a* in said biasing member 39, as well as bias spring 70. Insert die assemblies 40 are disposed on inner surface 31 of supplemental slip member 30. Locking rod 52 is received between supplemental slip member 30 and insert die members 40 and is secured in place using locking plate 50 which is anchored to supplemental slip member 30 using locking bolts 51 in threaded bores 34**.

Referring to FIG. 1, when slip assembly 100 of the present invention is used to grip against the external surface of pipe section 200, supplemental slip members 30 will first engage against said pipe section 200. As noted above, said supplemental slip members 30 are oriented at a smaller slip angle (that is, a slip angle having a larger vertical component) than central slip members 20. Said supplemental slip members 30 cooperate to exert sufficient radial force on said pipe section 200 so that said pipe section 200 will not slip or fall in an axial direction, even at lower string weights.

Figure 6:
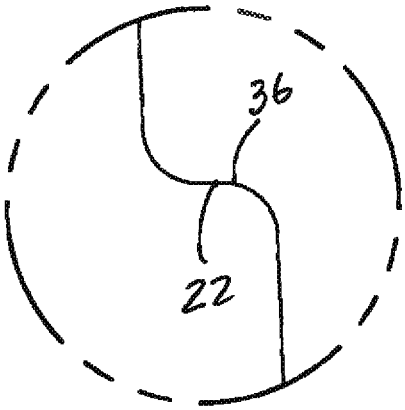
FIG. 6 depicts a detailed view of the highlighted area depicted in FIG. 4.
Figure 7:
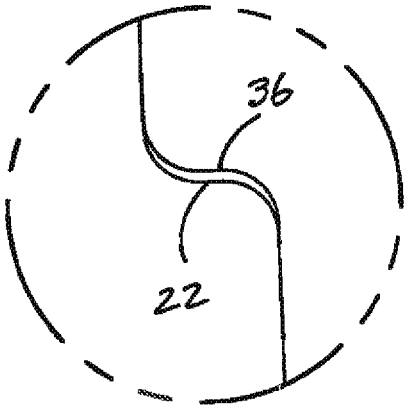
FIG. 7 depicts an alternative detailed view of the components in FIG. 6.

Although the more aggressive vertical slip angle of supplemental slip members 30 could ordinarily crush or otherwise damage pipe section 200, said supplemental slip members 30 have a limited axial travel distance. Specially, as depicted in FIG. 7, as outer surface 31 of a supplemental slip member 30 slidably moves along the inner surface 21 of central slip member 20, downwardly-facing shoulder(s) 36 of said supplemental slip member 30 moves toward upwardly-facing shoulder(s) 22 of central slip member 20. As depicted in FIG. 6, eventually said downwardly-facing shoulder(s) 36 of said supplemental slip member 30 bottom out against upwardly-facing shoulder(s) 22 of central slip member 20.

Referring to FIG. 5, threaded bolt 60 can be adjusted within threaded bore 24. When said threaded bolt 60 is unscrewed relative to said threaded bore 24, bias spring 70 acts to direct supplemental slip member 30 upward relative to central slip member 20. As such, downwardly-facing shoulder(s) 36 of said supplemental slip member 30 separate or form a gap relative to opposing upwardly-facing shoulder(s) 22 of central slip member 20 (see FIG. 7). In this manner, the travel distance between said opposing shoulders can be adjusted, thereby accommodating pipe having different sizes and/or specifications.

Because downward movement of supplemental slip members 30 is limited, inward radial movement of insert die assemblies 40 is likewise limited. As a result, teeth 42 of insert die assemblies 40 are permitted to penetrate the outer surface of pipe section 200 only a predetermined amount. In a preferred embodiment, said teeth 42 generate a sufficient friction factor (typically over 1) against pipe section 200, even when debris or foreign material (for example, mill scale, pipe dope or drilling mud) is on the outer surface of such pipe, in order to securely grip said pipe section 200.

After downwardly-facing shoulder(s) 36 of said supplemental slip member 30 bottom out against upwardly-facing shoulder(s) 22 of central slip member 20, the less aggressive slip angle (that is, a slip angle having a larger horizontal component) of said central slip members 20 acting against inner surface 13 of slip bowl assembly 10 take over. As a result, this less aggressive angle ensures that radial loading will not increase as quickly as pipe weight or other axial loading increases, thereby minimizing the crushing effect of such combined slip members on pipe section 200.

Slip assembly 100 of the present invention automatically transfers from the more aggressive (more vertical) slip angle of the supplemental slip members 30 to the less aggressive (more horizontal) slip angle of the central slip members 20. Thus, no interaction from an operator is required, thereby reducing the risk associated with human error. Slip assembly 100 of the present invention has a large gripping range so multiple pipe diameters can be accommodated without significant changing of parts or other equipment in the field.

Additionally, angled outer surface 25 of central slip member is substantially flat. Conventional slip and bowl assemblies typically include a cone member machined into a bowl and a matching cone member machined onto a corresponding slip member segment. Such a design is adequate when only a single pipe size is gripped with each slip configuration because the taper of the slip and the bowl match exactly when it contacts the pipe keeping the die contact on the pipe vertical, and distributing the load into the pipe evenly.

Slip assemblies exist that can grip multiple pipe diameters without changing slip inserts. However, such assemblies are generally not compatible with such conventional cone designs. If slip members do not sit in a bowl at a machined position, the back of each slip member segment will only be supported in the center not on the sides—or, alternatively, only on the outside edges and not in the center.

By contrast, the slip assembly of the present invention comprises a substantially flat back side along with a mating substantially flat surface on the inner surface of slip bowl assembly, thereby permitting a uniformly distributed load on the back of each slip member throughout the gripping range of the slip member, insuring a more uniform contact on pipe and minimizing any pinching or stress concentration areas.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A slip assembly for gripping pipe and other tubulars comprising:

a) a slip bowl member having a central bore defining a tapered inner bowl surface;

b) a first slip member having first tapered inner slip surface, a first tapered outer slip surface, and at least one substantially upwardly facing shoulder on said first tapered inner slip surface, wherein said first tapered outer slip surface is slidably disposed on said inner bowl surface;

c) a second slip member having a second inner slip surface, a second tapered outer slip surface and at least one substantially downwardly facing shoulder on said second tapered outer slip surface, wherein said second tapered outer slip surface of said second slip member is slidably disposed on said first tapered inner slip surface of said first slip member;

d) at least one insert die member disposed on said second inner slip surface of said second slip member; and e) a bias spring disposed between said first and second slip members wherein said bias spring is adapted to create a gap between said upwardly and downwardly facing shoulders, and wherein said upwardly and downwardly facing shoulders contact each when gripping force exerted by said second slip member on a pipe section exceeds a predetermined amount.

2. The slip assembly of claim 1, wherein said tapered inner bowl surface and first tapered outer slip surface of said first slip member define a first acute angle from a longitudinal axis of said pipe section, said first inner slip surface of said first slip member and said second tapered outer slip surface of said second slip member define a second acute angle from the longitudinal axis of said pipe section, and said first acute angle is larger than said second acute angle.

3. The slip assembly of claim 1, wherein the size of said gap between said upwardly and downwardly facing shoulders is adjustable.

4. A slip assembly for gripping pipe and other tubulars comprising:

a) a slip bowl member having a central bore defining a first tapered inner bowl surface;

b) a first plurality of slip members, each having an inner surface, an outer surface, and at least one substantially upwardly facing shoulder on said inner surface, wherein said outer surfaces are slidably disposed on said tapered inner bowl surface and said inner surfaces cooperate to define a second tapered bowl surface;

c) a second plurality of slip members, each having an inner surface, an outer surface and at least one substantially downwardly facing shoulder on said outer surface, wherein said outer surfaces of said second plurality of slip members are slidably disposed on said second tapered bowl surface defined by said inner surfaces of said first plurality slip members;

d) a plurality of insert die members disposed on said inner surfaces of said second plurality of slip members; and e) a bias spring disposed between said first plurality and second plurality of slip members wherein said bias spring is adapted to create a gap between said upwardly and downwardly facing shoulders, and wherein said upwardly and downwardly facing shoulders close said gap and contact each other when gripping force exerted by said second plurality of slip members on a pipe section exceeds a predetermined amount.

5. The slip assembly of claim 4, wherein said outer surfaces of said first plurality of slip members define a first acute angle from a longitudinal axis of said pipe section, said inner surfaces of said first plurality of slip members and outer surfaces of said second plurality of slip members define a second acute angle from the longitudinal axis of said pipe section, and said first acute angle is larger than said second acute angle.

6. The slip assembly of claim 4, wherein the size of said gap between said upwardly and downwardly facing shoulders is adjustable.

7. A method of gripping pipe and other tubulars comprising:

a) inserting a section of pipe in a slip assembly, said slip assembly comprising:

i) a slip bowl member having a central bore defining a first tapered inner bowl surface;

ii) a first plurality of slip members, each having an inner surface, an outer surface, and at least one substantially upwardly facing shoulder on said inner surface, wherein said outer surfaces of said first plurality of slip members are slidably disposed on said first tapered inner bowl surface, and said inner surfaces of said first plurality of slip members cooperate to define a second tapered bowl surface;

iii) a second plurality of slip members, each having an inner surface, an outer surface and at least one substantially downwardly facing shoulder on said outer surface, wherein said outer surfaces of said second plurality of slip members are slidably disposed on said second tapered bowl surface defined by said first plurality of slip members;

iv) at least one insert die member disposed on said inner surfaces of said second slip members;

v) at least one bias spring disposed between said first plurality and second plurality of slip members, wherein said at least one bias spring is adapted to create a gap between said upwardly and downwardly facing shoulders;

b) engaging said second plurality of slip members against said pipe section and said second tapered bowl defined by said inner surfaces of said first plurality of slip members;

c) closing said gap between said upwardly and downwardly facing shoulders, wherein said shoulders contact each other, when pipe gripping force exerted by said second plurality of slip members exceeds a predetermined amount; and d engaging said first plurality of slip members against said first tapered inner bowl surface of said slip bowl.

8. The method of claim 7, wherein said outer surfaces of said first plurality of slip members define a first acute angle from a longitudinal axis of said section of pipe, said inner surfaces of said first plurality of slip members and outer surfaces of said second plurality of slip members define a second acute angle from the longitudinal axis of said pipe section, and said first acute angle is larger than said second acute angle.

9. The method of claim 7, wherein the size of said gap between said upwardly and downwardly facing shoulders is adjustable.

* * * * *